US006515280B1

(12) United States Patent
Baykut

(10) Patent No.: US 6,515,280 B1
(45) Date of Patent: Feb. 4, 2003

(54) METHOD AND DEVICE FOR MATRIX ASSISTED LASER DESORPTION IONIZATION OF SUBSTANCES

(75) Inventor: Gökhan Baykut, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 09/525,234

(22) Filed: Mar. 15, 2000

(30) Foreign Application Priority Data

Mar. 17, 1999 (DE) ..... 199 11 801

(51) Int. Cl.[7] ..... H01J 49/04
(52) U.S. Cl. ..... 250/288
(58) Field of Search ..... 250/288

(56) References Cited

U.S. PATENT DOCUMENTS

| | | | | |
|---|---|---|---|---|
| 5,294,797 A | | 3/1994 | Frey et al. | |
| 5,373,156 A | * | 12/1994 | Franzen | 250/288 |
| 5,689,111 A | * | 11/1997 | Dresch et al. | 250/287 |
| 5,770,860 A | * | 6/1998 | Franzen | 250/288 |

FOREIGN PATENT DOCUMENTS

| | | |
|---|---|---|
| DE | 196 30 547 A1 | 1/1998 |
| GB | 2 307 782 A | 6/1997 |

OTHER PUBLICATIONS

Franz Hillenkamp et al; Ronald C. Beavis et al.; MatrixAssisted Laser Desorption/Ionization Mass Spectrometry of Biopolymers; Analytical Chemistry, vol. 63, No. 24, Dec. 15, 1991; pps. 1193 A–1203 A.

A.N. Krutchinsky et al.; Orthogonal Injection of Matrix–Assisted Laser Desorption/Ionization Ions into a Time–ofFlight Spectrometer Through a Collisional Damping Interface; Rapid Communications in Mass Spectrometry, 12, (1998); pps. 508–518.

* cited by examiner

*Primary Examiner*—Jack Berman

(57) ABSTRACT

A matrix assisted laser desorption ionization (MALDI) source with the capability of exposing the sample to a local gas pulse exactly at the point where the laser desorption process occurs, helps reduce the excess kinetic energy of the generated ions. Thus, it allows a better control of the ions during their transfer to and capture in ion trap mass spectrometers. Avoiding the unnecessary pressure increase, the MALDI source helps reduce pump-off times and the performance decrease particularly in Fourier transformation ion cyclotron resonance mass spectrometers. In addition, it allows the use of pulsed reactive gases in connection with direct or matrix assisted laser desorption, which can lead to the formation of novel product ions. The MALDI source also provides the capability of capturing and accumulating the ions in an in-source multipole ion guide for increasing the sensitivity of the method.

20 Claims, 3 Drawing Sheets

METHOD AND DEVICE FOR MATRIX ASSISTED LASER DESORPTION IONIZATION OF SUBSTANCES

FIELD OF THE INVENTION

The invention relates to a method and a device for matrix-assisted laser desorption ionization.

PRIOR ART

Conventional methods for the ionization of substances for analysis by mass spectrometry, where a solid substance is heated, for example, transferred to the gaseous phase and ionized there by electron collision, cannot be applied to the large organic and biological molecules. Electron collision with energetic electrons (typically 70 eV) leads to a substantial fragmentation of this species, whereby only small fragments can be observed. On the other hand, even if energy is only supplied at a slow rate, as is always the case when heating a solid sample, large organic molecules decompose before they can vaporize. Only if energy supply takes place at an extremely fast rate, as is the case with a laser beam, for example, the usually slower decomposition process of the molecules does not occur at all.

Laser desorption ionization was already used in the last decade to transfer large organic molecules to the gaseous phase and to ionize them. A special type of laser desorption ionization (LDI) is matrix-assisted laser desorption ionization (MALDI). The detailed review article by F. Hillenkamp, M. Karas, R. Beavis, and B. Chait in "Analytical Chemistry", Volume 63, year 1991, on pages 1193A–1203A, reports about this technology. In MALDI the analyte molecules are mixed with a so-called matrix. The analyte/matrix molar ratio is $1:10^2$ to $1:10^4$. The laser energy is absorbed by matrix molecules and passed on to analyte molecules. The latter thus receive the necessary energy to enter the gaseous phase and are thereby partially ionized. The ionization usually takes place by a protonation. The substances which are mostly used as a matrix are proton donors. In special cases, alkali-metal salts or silver salts are also added to achieve alkali-metal or silver attachment. With some samples both protonated analyte molecules and small quantities of sodium adducts are also observed. The latter often form due to the presence of sodium chloride residues in biological samples.

Experience shows that the ions formed by the MALDI process have kinetic energy which is not negligible and which can be up to or over 10 eV. Since in the classical time-of-flight mass spectrometry the MALDI-generated ions are normally extracted and accelerated at voltages of between 15 and 30 kV, an energy spread of about 10 eV is relatively unimportant here. However, in ion trap mass spectrometers like the Fourier transform ion cyclotron resonance mass spectrometers (FTICRs) the ions produced in an external ion source must be transferred to the trap and captured there. Therefore, the extraction of the MALDI-generated ions no longer takes place here at a potential difference of several kilovolts. However, in the range of low ion extraction potential, which does not exceed 10–20 V, a fluctuation of excess energy in the region of 10 eV is too high and therefore causes enormous difficulties. It leads to a considerable intensity variation of the obtained mass signals and therefore to irreproducible analytical results.

In Fourier transform ion cyclotron resonance mass spectrometry (FTICR-MS) one attempts by various methods to capture the ions in the trap with as few losses as possible and first of all effectively reduce their energy for the ICR measurements. This happens, for instance, by dynamic trapping, where an inert gas is also pulsed into the ion cyclotron resonance trap (ICR trap) in order to absorb the kinetic energy of the ions by collisions with gas molecules or atoms.

One can also attempt to cool the ions in the ion source. This method uses an increased static pressure in the source so that the ions generated by MALDI lose their energy immediately by collisions. According to a different method the MALDI process can even be performed at atmospheric pressure. The U.S. Pat. No. 5,663,561 describes such a device for atmospheric pressure laser desorption ionization. In this case matrix substances are used which undergo photolytic of thermolytic decomposition. However, as opposed to MALDI, the gases formed during this atmospheric pressure desorption are not intended to ionize the large analyte molecules. The selection of matrix molecules therefore only depends on their capability to liberate the large molecules by desorption. Analyte molecules catapulted into the gaseous phase are then ionized for example by a corona discharge. The corona discharge primarily forms nitrogen ions which, in turn, ionize water molecules in moist air, which then perform the ionization of the analyte molecules.

In FTICR mass spectrometry with an external MALDI ion source the dynamic trapping of the ions that are formed in a low voltage MALDI source requires an electrical "opening and closing" of the ICR trapping plate facing the ion source. This is usually combined with an increase of the trapping potential of the rear trapping plate. Capturing higher-energy ions in an ion trap is always problematic. A loss-free capture is especially difficult if a swarm of ions with a broad energy spread arrives from such a MALDI source. In FTICR mass spectrometry one also uses frequently a pulsed inert gas in the ICR trap. Collisions with these gas molecules remove the excess energy of the MALDI-generated ions. Thus, reduced-energy ions are obtained which can be resonantly excited and detected in the ICR trap. However, FTICR mass spectrometry requires a very good vacuum of around $\leqq 10^{-9}$ mbar in the analyzer range, particularly in order to achieve the high resolution. In FTICR one avoids operating at pressures above $10^{-8}$ mbar since the broadening of the ion cyclotron resonance signals disturbs the measurements. If the capture of the ions is associated with a gas pulse, one has to wait for a time period after each gas pulse-assisted ion trapping until the pulsed gas is pumped out. This time period can be 5–10 seconds or even longer, thus, a much longer time is required to add up a multitude of spectra.

These problems appear if the ions in MALDI source are transferred to the ICR trap by a low voltage extraction and acceleration. Therefore, it seems to be simpler to absorb the excess kinetic energy of the MALDI-generated ions already in the source by collisions with gas molecules.

The alternative to increasing the pressure in the ICR trap is to statically increase the pressure in the ion source of an FTICR mass spectrometer. As described above, the collisions with gas molecules would already remove the excess energy from MALDI-generated ions at the location of their formation. A MALDI ion source with statically increased pressure, in connection with time-of-flight mass spectrometry though, was described in the publication by A. N. Krutchinsky, A. V. Loboda, V. L. Spicer, R. Dworschak, W. Ens, and K. G. Standing in "Rapid Communications in Mass Spectrometry", Volume 12, year 1998, on pages 508 to 518. However, when a statically increased source pressure is applied to FTICR mass spectrometry in order to achieve a higher analyte yield for MALDI, it leads also to a higher static pressure in the ICR trap. A certain increase in trap pressure occurs despite a differentially pumped system if the source pressure rises to levels such as 0.01 or 0.1 mbar, which in turn can considerably affect the performance of the FTICR system (broader peak, reduced resolution).

Ultimately, the methods proposed so far using a high static pressure in the laser desorption ion source, e.g. atmospheric pressure (4 or 5 orders of magnitude higher than a source pressure increased statically to 0.1 or 0.01 mbar) are not intended for classic MALDI processes. They are new techniques associated with atmospheric pressure ionization with the aid of an additional reactant gas, whereby the classic matrix substances are not normally used.

OBJECTIVE OF THE INVENTION

It is the objective of the invention to find a device and a method for absorbing the excess kinetic energy of the ions formed in a MALDI ion source, immediately after their formation and locally in the ion source. During the cooling process of ions, the vacuum in the rest of the mass spectrometer should preferably not be affected.

SUMMARY OF THE INVENTION

The invention consists of absorbing the excess kinetic energy of the MALDI-generated ions in the ion source by collisions with the introduced gas molecules. The invention introduces a device, in which the collision gases are pulsed directly onto the MALDI sample through a thin tube or a capillary by using a pulse valve. A gas pulse which is synchronized with the laser pulse (a certain period of time before or after the laser pulse, or during the laser pulse) generates a short-time increase of the local pressure directly on the surface of the applied substance. The analyte ions generated with excess energy collide with the pulsed gas molecules and lose some of their energy before they leave the ion source. These ions can now be extracted from the ion source zone at a low voltage (e.g. 10–20 volts) and passed on into the mass spectrometry analyzer. If the excess energy is absorbed effectively, other problems associated with a spread in the ion energy are also eliminated. The local pressure increase on the surface of the sample can be achieved by using much less collision gas than a static pressure increase of the source would require. The effect is the same but a much smaller quantity of collision gas is required and therefore does not cause an unnecessary pressure increase in the rest of the vacuum system of the mass spectrometer, which could lead to a performance reduction.

A different perspective of the invention is that reaction gases can be introduced through other gas tubes to the direct vicinity of the substance to be desorbed. In this way primary ions which form by matrix assisted laser desorption can react with reactive neutral molecules. Product ions from these reactions are transferred into the mass spectrometric analyzer just like the desorbed primary ions and detected. Ion molecule reactions in a MALDI ion source are interesting not only with regard to the ion chemistry. They can also be useful for analytical purposes. If a suitable reaction gas is selected, such reactions of the desorbed ions can lead to a kind of "derivatization effect" and therefore provide a further dimension of information for the substance to be analyzed.

Observations indicate that by a MALDI process at increased pressure (due to inert gas) more analyte ions can be detected near the point of desorption. It may be assumed that the collisionally induced cooling of the desorbed ions, which otherwise have excess energy, prevents losses during collection and transmission of the ions. The slower expansion of the desorbed swarm of matrix and analyte ions, as well as matrix and analyte molecules, may also permit greater production of analyte ions in the source, because there is more time available for post desorptive ion-molecule interactions (e.g. proton transfer).

An RF multipole ion guide which is placed directly in front of the laser desorption point can additionally protect a swarm of ions against fast expansion. When the MALDI process is assisted by an inert gas pulse and the ions are also simultaneously collected in a multipole ion guide direct, the above-mentioned effects are intensified. Here the multipole ion guide can, for example, be a quadrupole, a hexapole or an octopole.

DETAILED DESCRIPTION

Figure 1:
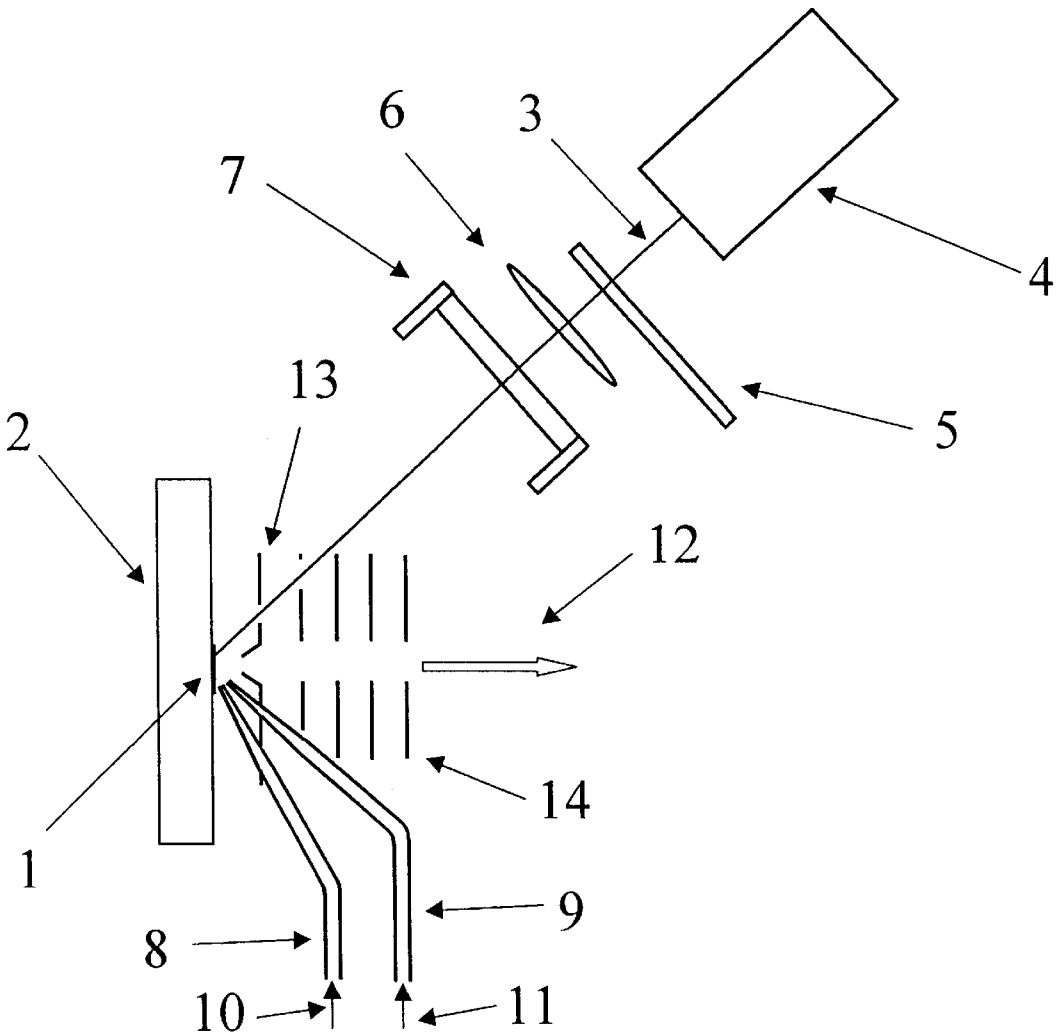
FIG. 1 shows a matrix assisted laser desorption ion source with two gas supply tubes, whereby the collision gas or the reaction gas can be pulsed directly onto the sample.

FIG. 1 describes a matrix-assisted laser desorption source with collision gas and reaction gas tubes. The sample (1) is located on the sample carrier (2). The beam (3) of the laser (4) is attenuated by an attenuator (5) as required, focused by the lens (6), and directed through a laser window (7) onto the sample (1). In the same way, two capillary tubes (8 and 9) are directed to the surface of the sample. The collision gas tube (8) supplies the collision gas (10) and the reaction gas tube (9) supplies the reaction gas (11). To extract the ions (12) formed by matrix assisted laser desorption and to guide them into the the mass spectrometric analyzer an extraction plate (13) and an ion lens system (14) are installed.

Figure 2:
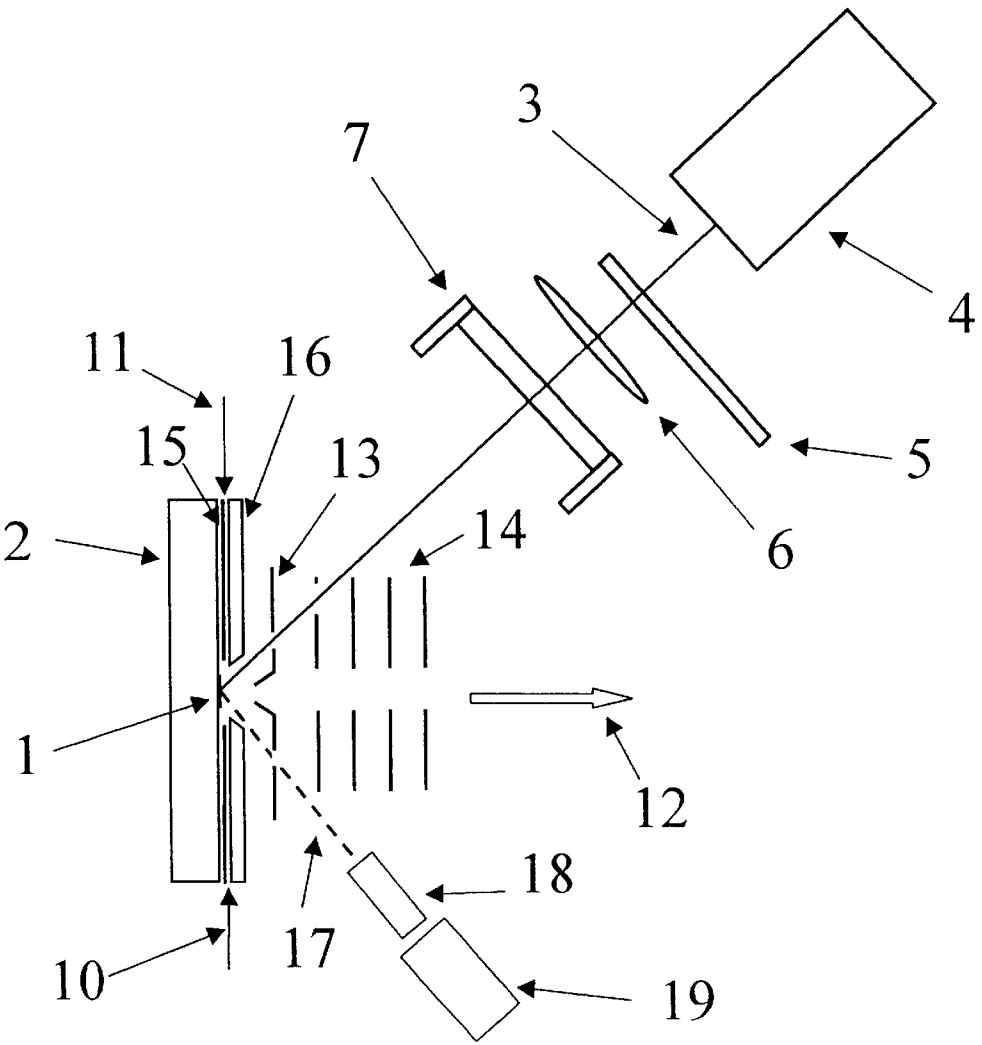
FIG. 2 shows an embodiment of the matrix-assisted laser desorption ion source, whereby the supplied gases are pulsed onto the sample over an area through a slit around the sample in order to allow adequate space for the laser optical components and observation optics.

FIG. 2 describes a different embodiment of a matrix assisted laser desorption source with collision gas and reaction gas supplies. A plate (15) is placed here parallel to the surface, very close to the sample support A cover plate (16) ensures that a circular slit around the sample is created between those two plates. This slit is used to pulse gases onto the sample surface. Inert collision gases to cool the MALDI-generated ions, as well as reaction gases are pulsed onto the sample through this slit instead of through the capillary tubes. As a result of this flat design there are no obstacles for the ion lens system, or, for example, for the observation lens system. 17 is the light beam which leads through the telescope (18) into the camera (19).

Figure 3:
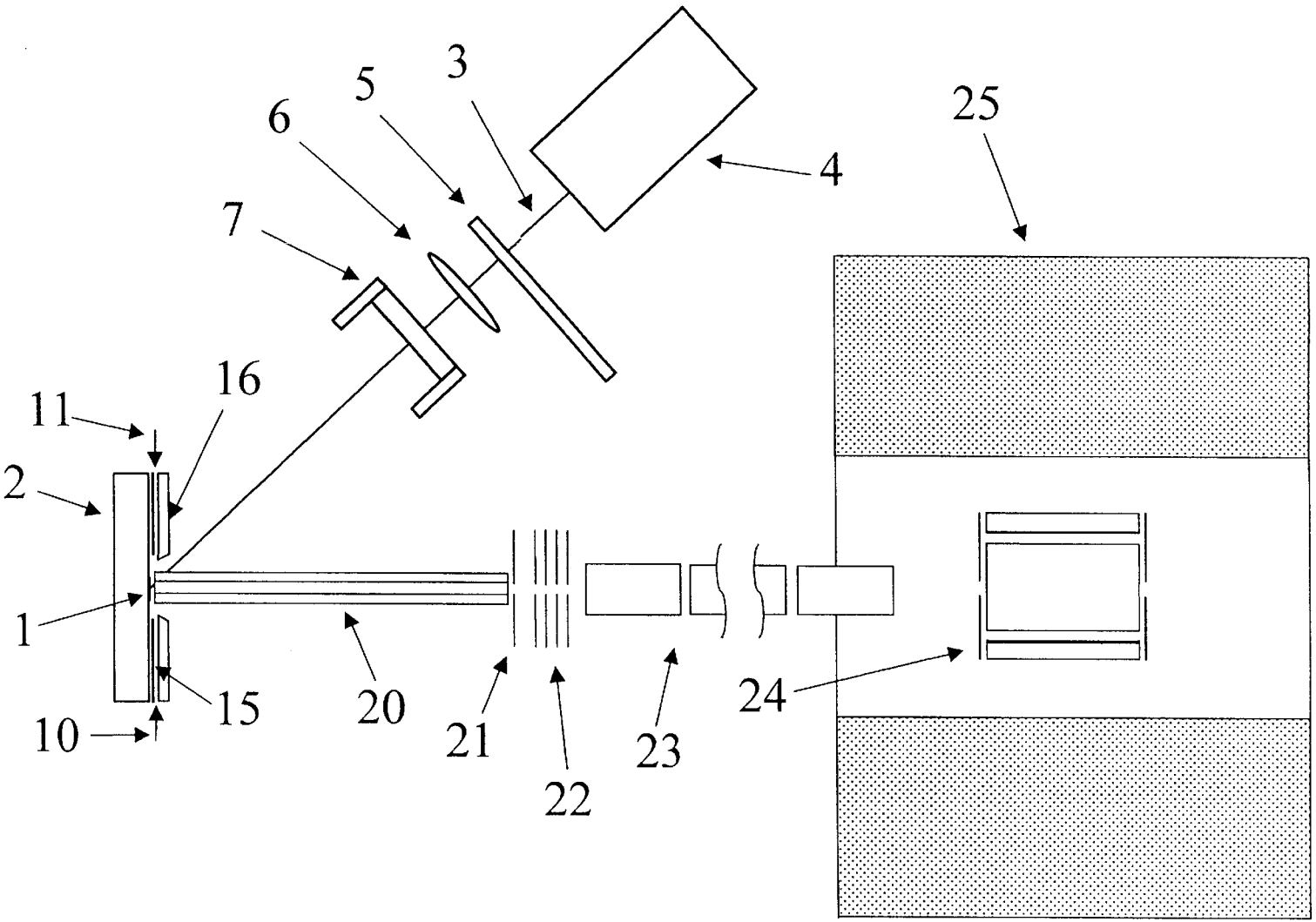
FIG. 3 shows a matrix assisted laser desorption ion source in which the supplied gases are pulsed onto the sample through a flat, circular slit, as in FIG. 2. However, in this case the desorbed ions are not extracted into an ion lens system but the laser desorption practically delivers the ions directly into a multipole ion guide.

FIG. 3 depicts an ion source, for matrix assisted laser desorption with collision gas and reaction gas supplies. As in FIG. 2, the gases here are introduced to the sample (1) through an area slit. Ions which are formed by matrix assisted laser desorption in this source are captured in the multipole ion guide (20). In this source the excess kinetic energy of the ions can be absorbed by a collision gas.

Simultaneously, ion losses can be largely prevented by desorption into a multipole ion guide. Ions which are desorbed into the multipole can be collected here. The multipole ion guide in this case can be any multipole system, as for example a quadrupole, hexapole, octopole etc. An accumulation in the multipole of the positive ions desorbed by several laser shots can be achieved by applying a positive potential (e.g. 10–20 V) to the ion extraction plate (21). The DC offset of the multipole ion guide is very low at around 1–2 volts. Thus, the extraction plate (21) potential on one end and the positive voltage of the sample carrier (2) on the other end (also 10–20 volts) form a potential well along the multipole ion guide for the axial trapping of positive ions. The radial trapping is performed by the oscillating multipole fields. To analyze the accumulated ions, a negative voltage pulse is applied to the ion extraction plate (21), upon which the ions are transferred through the ion lenses (22) and the ion transfer optics system (23) of the Fourier transform ion cyclotron resonance (FTICR) mass spectrometer to the ICR trap. Similarly, during generation and accumulation of negative ions the voltage of the sample carrier and the extraction plate are both negative (again 10–20 volts). During ion extraction out of the multipole, the polarity of the extraction plate is changed to positive. The ICR trap (24) is placed in the middle of the magnetic field of the superconducting magnet (25). There are many cases where a single laser shot does not generate a large number of ions, thus, ions from several laser shots are collected. An accumulation of the ions which are created by several consecutive laser shots leads to an increase in the intensity of the mass signal.

For MALDI processes it is always an advantage to use a multiple sample support if analyses are conducted with a large number of correlating samples. To achieve a high throughput, robotic sample preparation systems can be applied which, for instance, take the MALDI samples directly from a series of prepared solutions and apply them to the MALDI sample support plate. These solutions are usually prepared in a so-called microtiter plate, which contains 96 (8×12) or 384 (16×24), or even 1,536 (32×48) etc. samples covering a rectangular area. An analogous version of the MALDI sample support will create considerable advantages for automation. For this reason the invention will use this alternative of a multi-sample support in the form of a microtiter plate, thus simplifying automation and thus allowing a high throughput.

What is claimed is:

1. A method for generating analyte ions from a sample on a sample carrier by pulsed matrix assisted laser desorption, the method comprising:

directing a laser shot at the sample to cause desorption thereof; and subjecting the sample to a local gas pulse that is synchronized with the laser shot so as to increase the local pressure surrounding the sample during said desorption.

2. The method according to claim 1 wherein a multipole ion guide is located in front of the sample, such that a swarm of ions formed by the desorption expands into the ion guide.

3. The method according to claim 2, further comprising trapping and accumulating the swarm of ions with other ions in the multipole ion guide before transferring said ions to a mass spectrometric analyzer.

4. The method according to claim 1, wherein ions, which are laser desorbed from a sample, are subjected either to an inert gas pulse or to a reaction gas pulse, or to both, at the place of the sample.

5. The method according to claim 2, wherein ions, which are laser desorbed from a sample, are subjected either to an inert gas pulse or to a reaction gas pulse, or to both, at the place of the sample.

6. The method according to claim 1, wherein a multi-sample carrier plate in the form of a microtiter plate is used as the sample carrier.

7. The method according to claim 3, wherein a multi-sample carrier plate in the form of a microtiter plate is used as the sample carrier.

8. A device for generating analyte ions from a sample on a sample carrier by matrix assisted laser desorption in order to fulfill the method of claim 1, wherein at least one gas supply tube leads to the direct vicinity of the laser desorption point.

9. The device according to claim 8, wherein at least one of the gas supply tubes consists of a capillary tube.

10. The device according to claim 8, the device comprising a flat gas supply tube in form of a slit around the sample that guides gases onto the sample.

11. The device according to claim 8, wherein a multipole ion guide is placed in front of the sample.

12. A matrix assisted laser desorption ionization apparatus for generating analyte ions from a sample on a sample carrier, the apparatus comprising:

a laser directed at the sample such that a laser pulse may be used to cause sample desorption; and a local gas source that provides a gas pulse in the local vicinity of the sample such that a local pressure surrounding the sample is temporarily increased by the pulse, the gas pulse being synchronized with the laser shot so that the temporary pressure increase coincides with the desorption.

13. The apparatus according to claim 12 further comprising a multipole ion guide located in front of the sample, such that a swarm of ions formed by the desorption expands into the ion guide.

14. The apparatus according to claim 13, wherein the swarm of ions is trapped and accumulated with other ions in the multipole ion guide before being transferred to a mass spectrometric analyzer.

15. The apparatus according to claim 12, wherein ions, which are laser desorbed from the sample, are subjected to at least one of an inert gas pulse and a reaction gas pulse at the sample location.

16. The apparatus according to claim 12 wherein a multi-sample carrier plate in the form of a microtiter plate is used as the sample carrier.

17. The apparatus according to claim 12 wherein the apparatus comprises at least one gas supply tube leading to a direct vicinity of the laser desorption.

18. The apparatus according to claim 17, wherein the gas supply tube comprises a capillary tube.

19. The apparatus according to claim 17, the apparatus comprising a flat gas supply tube in form of a slit around the sample that guides gases onto the sample.

20. The apparatus according to claim 17 further comprising a multipole ion guide located in front of the sample.

* * * * *